US005157446A

United States Patent [19]

Kusaka

[11] Patent Number: 5,157,446

[45] Date of Patent: Oct. 20, 1992

[54] HEATING APPARATUS WITH A FILM HAVING HIGH AND LOW ELECTRICAL RESISTANCE LAYERS

[75] Inventor: Kensaku Kusaka, Kawasaki, Japan

[73] Assignee: Canon Kabushiki Kaisha, Tokyo, Japan

[21] Appl. No.: 811,107

[22] Filed: Dec. 20, 1991

[30] Foreign Application Priority Data

Dec. 21, 1990 [JP] Japan ..... 2-413117

[51] Int. Cl.[5] ..... G03G 15/20

[52] U.S. Cl. ..... 355/285; 219/216; 355/284; 432/60

[58] Field of Search ..... 355/282, 284, 285, 290, 355/295; 219/216; 118/60; 432/60

[56] References Cited

U.S. PATENT DOCUMENTS 3,948,215 4/1976 Namiki ..... 118/60
4,001,546 1/1977 Johnson, Jr. et al. ..... 432/60 X
4,242,566 12/1980 Scribner ..... 118/60 X
4,430,412 2/1984 Miwa et al. ..... 118/60 X
4,565,439 1/1986 Reynolds ..... 219/216 X
4,755,849 7/1988 Tarumi et al. ..... 432/60 X

FOREIGN PATENT DOCUMENTS 0025471 2/1991 Japan ..... 355/290
0025483 2/1991 Japan ..... 355/290

*Primary Examiner*—A. T. Grimley
*Assistant Examiner*—William J. Royer
*Attorney, Agent, or Firm*—Fitzpatrick, Cella, Harper & Scinto

[57] ABSTRACT

A heating apparatus includes a heater generating heat upon electric power supply thereto; a film, wherein an image on a recording material is heated by heat from the heater through the film; wherein the film comprises a high resistance layer at a side remote from the recording material and a low resistance layer at a side remote from the heater; and wherein an area of the high resistance layer is larger than an area of the low resistance layer.

12 Claims, 4 Drawing Sheets

HEATING APPARATUS WITH A FILM HAVING HIGH AND LOW ELECTRICAL RESISTANCE LAYERS

FIELD OF THE INVENTION AND RELATED ART

The present invention relates to a heating apparatus for heating an image on a recording material through a heat resistive film to fix the image on the recording material in order to improve the image quality.

A conventional heating apparatus used for heat-fixing an image on a recording material, for example, comprises a heating roller maintained at a predetermined temperature and a pressing roller having an elastic layer, the pressing roller being press-contacted to the heating roller to form a nip, through which a recording material is passed. However, in such a heat-roller type device, the warming up period required for the surface of the heating roller to reach the predetermined temperature is long, and the power consumption is large. In addition, it also involves the problem of the toner offset.

In order to provide a solution to the problems, U.S. Ser. No. 206,767 which has been assigned to the assignee of this application, has proposed a heating apparatus in which the image on the recording material is heated through a thin film which is heated by a heater having a low thermal capacity. Also, it has been proposed that the film is of multi-layer structure having at least one heat resistive layer and a parting layer contactable to the toner image, wherein the parting layer has a low resistance, that is, not more than $10^{11}$ ohm.cm of volume resistivity. The film heating apparatus is advantageous in that the waiting period is reduced to permit quick start of the operation because of the use of the quick response heater and the thin film, in that the power consumption is reduced, in that the image disturbance or toner offset due to the electric charge of the film and also in that various other problems with the prior art can be avoided. However, the provision of the low resistance layer over the entire surface of the film give rise to the following problem. That is, in some cases electrical leakage occurs between the heater and the low resistance layer of the film at an end portion or portions of the film in the direction perpendicular to the direction of motion of the recording material. This tends to occur when the resistance material producing heat upon application of electric power thereto is close to the film, as shown in U.S. Ser. No. 206,767.

As in the case of a metal tension roller or another grounded conductive member disposed in contact or with close to the internal surface of the film, electric contact is established between the conductive member and the low resistance layer of the film, so that the surface of the film can be grounded.

The heating apparatus may be used as an image fixing apparatus for an image forming apparatus using an electrophotographic process, such as a copying machine. In such a case, if the recording material has a low resistance and if the distance between the fixing device and the electrostatic image transfer station using corotron or the like, is shorter than the length of the recording material, the electric charge applied onto the recording material surface by the corotron may leak from the low resistance layer on the film surface through the recording material with the result of lower image transfer efficiency.

SUMMARY OF THE INVENTION

Accordingly, it is a principal object of the present invention to provide a heating apparatus which is substantially free from the electric charge leakage between the heater and the film.

It is another object of the present invention to provide a heating apparatus wherein the leakage of the transfer electric charge from the recording material is prevented.

It is a further object of the present invention to provide a heating apparatus having a high resistance layer and a low resistance layer, in which the area of the high resistance layer is larger than that of the low resistance layer.

It is a yet further object of the present invention to provide a heating apparatus in which the low resistance layer is provided except at the end or ends of the film in the direction perpendicular to the movement direction of the recording material.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
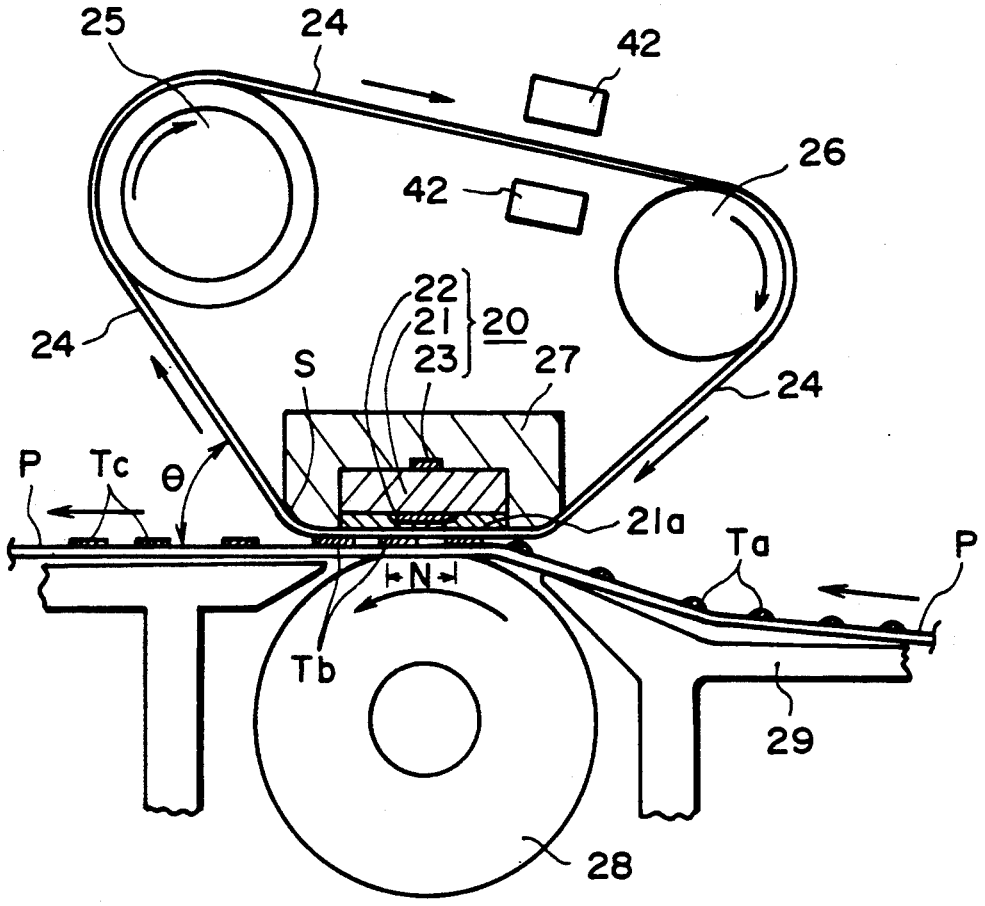
FIG. 1 is a sectional view of an apparatus according to a first embodiment of the present invention.

FIG. 1 shows an example of a heating apparatus according to an embodiment of the present invention. In FIG. 1, a heat resistive film (an image fixing film) 24 in the form of an endless belt is trained around three parallel members, i.e., a driving roller (left side) 25, a follower roller 26 (right side) of metal and a low thermal capacity linear heater 20 disposed between and below the driving roller 25 and the follower roller 26.

The follower roller 26 also functions as a tension roller for the fixing film 24. The fixing film rotates at a predetermined peripheral speed in the clockwise direction by the clockwise rotation of the driving roller 25. The peripheral speed is the same as the conveying speed of the sheet having an image formed by an image, not shown, forming means so that the film is not creased, skewed or delayed.

A pressing roller 28 has a rubber elastic layer having a good parting property, such as silicone rubber or the like and is press-contacted to the heater 20 with the bottom travel of the fixing film 24 therebetween. The pressing roller is pressed against the heater at the total pressure of 4–7 kg by an urging means, not shown. It rotates co-directionally, that is, in the counterclockwise direction, with the fixing film 24.

The heater 20 is in the form of a low thermal capacity linear heater extending in a direction crossing with the film 24 surface movement direction (film width direction). It comprises a heater base 27 having a high thermal conductivity, a heat generating resistor 22 generating heat upon electric power supply thereto, and a temperature sensor 23. It is mounted on a heater support 21 having high thermal conductivity.

The heater support 21 supports the heater 20 with thermal insulation on an image fixing apparatus and therefore on a copying machine and is made from high heat durability resin such as PPS (polyphenylene sulfide), PAI (polyamide imide), PI (polyimide), PEEK (polyether ether ketone) or liquid crystal polymer material, or a compound material of such resin material and ceramics, metal, glass or the like material.

An example of the heater base 27 is in the form of an alumina plate having a thickness of 1.0 mm, a width of 10 mm and a length of 240 mm made of high conductivity ceramic material.

The heat generating resistor material 22 is applied by screen printing or the like along a longitudinal line substantially at the center, of the bottom surface of the base 27. The heat generating material 22 is, for example, Ag/Pd (silver palladium), $Ta_2N$ or another electric resistor material having a thickness of approximately 10 microns and a width of 1–3 mm. It is coated with a heat resistive glass 21*a* in the thickness of approximately 10 microns, as a surface protection layer. An example of a temperature sensor 23 is applied by screen printing or the like substantially at a center of a top surface of the base 27 (the side opposite from the side having the heat generating material 22). It is made of Pt film having low thermal capacity. Another example of the temperature sensor is a low thermal capacity thermistor contacted to the base 27.

The linear or stripe heater 22 is connected with the power source at the longitudinal opposite ends, so that the heat is generated uniformly along the heater. The power source in this example provides AC 100 V, and the phase angle of the supplied electric power is controlled by a control circuit, not shown, including triac in accordance with the temperature detected by the temperature detecting element 23.

A film position sensor 42 in the form of a photocoupler is disposed adjacent to a lateral end of the film 24. In response to the output of the sensor, the roller 26 is displaced by a driving means in the form of a solenoid not shown, so as to maintain the film position within a predetermined lateral range.

The fixing operation will be described. Upon image formation start signal, an unfixed toner image is formed on a recording material sheet by the image forming station. The recording material sheet P having an unfixed toner image Ta thereon is guided by a guide 29 to enter between the fixing film 24 and the pressing roller 28 at the nip N (fixing nip) provided by the heater 20 and the pressing roller 28. The sheet passes through the nip between the heater 20 and the pressing roller 28 together with the fixing film 24 without surface deviation, crease or lateral shifting while the toner image carrying surface is in contact with the bottom surface with the fixing film 24 moving at the same speed as the sheet. The heater 20 is supplied with electric power at a predetermined timing after generation of the image formation start signal so that the toner image is heated by the nip so as to be softened and fused into a softened or fused image Tb.

The fixing film 24 is sharply bent at an angle $\theta$ for example of about 45 degrees at an edge S (the radius of curvature is approximately 2 mm), that is, the edge having a large curvature in the heater support 21. By this, the sheet advanced together with the film 24 in the nip is separated by the curvature from the fixing film 24 at the edge S. Then, the sheet is the discharged to the sheet discharging tray. By the time sheet is discharged, the toner has sufficiently cooled and solidified and therefore is completely fixed (toner image Tc).

The toner used with this embodiment has a sufficiently high viscosity when it is heated and fused. Therefore, even if the toner temperature when it is separated from the fixing film is higher than the toner fusing point, the bonding strength among toner particles is very large as compared with the strength between the toner and the fixing films. Therefore, practically no toner off-set is produced to the fixing film 24 when the fixing film 24 and the sheet P is separated.

In this embodiment, the heat generating element 22 and the base 27 of the heater 20 have low thermal capacity, and in addition, it is supported on the support 21 through thermal insulation, and therefore, the surface temperature of the heater 20 in the nip quickly reaches a sufficiently high temperature in consideration of the toner fusing point (or a temperature at which the toner can be fixed on the sheet), and therefore, the stand-by temperature control (to increase the temperature of the heater 20 to a predetermined level beforehand), and therefore, the power consumption can be saved, and the temperature rise can be prevented.

A preferable example of the fixing film 24 is a multi-layer film having high heat-resistivity, parting property and durability and having a total thickness of not more than 100 microns, more preferably, not more than 50 microns.

Figure 2:
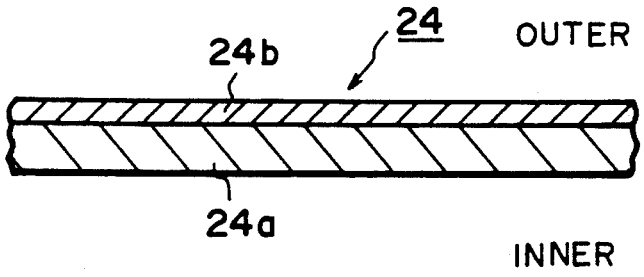
FIG. 2 is a sectional view illustrating the layer structure of the fixing film.

FIG. 2 is a sectional view of an example of a layer structure of a multi-layer film. It comprises a base layer (base film) 24*a* in the form of a heat resistive layer at a side contactable to the heater 20, and a low resistance parting layer 24*b* laminated on the outer surface of the heat resistive layer 24*a* at a side contactable to the recording material.

The materials usable for the heat resistive layer 24*a* include high resistance heat resistive resin material such as polyimide, polyether ether ketone (PEEK), polyethersulfone (PES), polyetherimide (PEI) or polyparabanic acid (PBA). Another possible alternative is a thin metal tube having an internal surface coated with high resistance resin or the like. Here, the high resistance means not less than $10^{11}$, preferably $10^{12}$ ohm.cm in the volume resistivity.

The major component of the parting layer 24*b* is preferably silicone, resin or fluorinated resin such as PTFE (polytetrafluoroethylene), PFA or FEP or the like. The lamination of the parting layer 24*b* on the heat resistive layer 24*a* may be provided by bonding lamination of the parting layer, electrostatic printing coating) of the parting layer material, evaporation, CVD or another film forming process, or co-extrusion of the heat resistive layer and the parting layer materials.

The parting layer 24*b* contains carbon black, graphite, conductive whiskers or another conductive member (low resistance material) so that the resistance of the surface of the fixing film 24 is lowered. By doing so, the electric charging of the surface of the fixing film 24 contactable to the toner can be prevented.

When the toner contactable side of the fixing film 24 is insulative, the surface of the fixing film may be electrically charged to such an extent that the toner image on the sheet P is disturbed or to the extent that the toner image transfers onto the fixing film 24 (so-called electrostatic offset). As will be understood, according to this embodiment, the problems can be avoided. The volume resistivity of the low resistance parting layer **24*b* is not more than $10^{11}$ ohm.cm, preferably not more than $10^9$ ohm.cm. In this embodiment, the volume resistivity is $10^0$ ohm.cm–$10^6$ ohm.cm. In this embodiment, the thickness of the heat resistive layer 24*a* is 20 microns, and the thickness of the low resistance parting layer 24*b*** is 10 microns. Therefore, the surface resistance of the parting layer is in this embodiment is not less than $10^3$ ohm/□ and not more than $10^9$ ohm/□.

Figure 3:
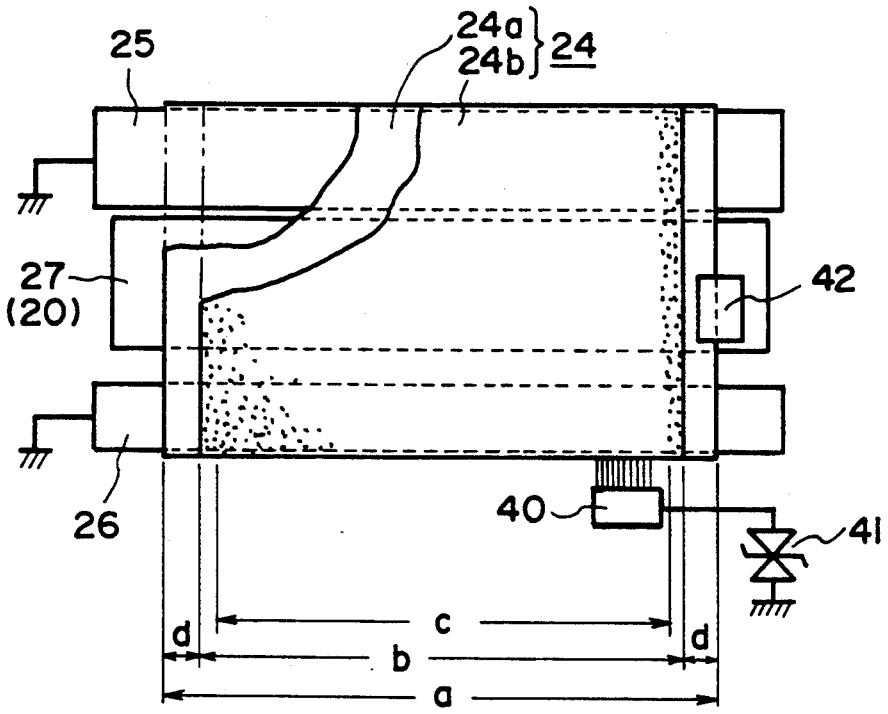
FIG. 3 is a top plan view of the apparatus.

FIG. 3 is a top plan view of an image fixing apparatus of FIG. 1 where a part is removed, wherein a is a width (dimension in a direction perpendicular to the movement direction of the film 24) of the high resistance heat resistive layer **24*a* of the film 24; b is a width (measured in the same direction) of the low resistance parting layer 24*b*; and c is a maximum width of a transfer material usable with this apparatus. In this embodiment, a>b>c. Thus, the low resistance parting layer 24*b* of the film 24 does not exist at the opposite ends in the direction of the width of the film 24**, but the high resistance heat resistive layer is exposed in the regions d.

A conductive brush 40 made of SUS wire, carbon fiber or the like is contacted to or disposed adjacent to the low resistance parting layer **24*b* of the film 24. The conductive brush 40 is grounded through a varistor 41 having a rated voltage of 500 V–1 KV, and therefore, the charging of the film 24** can be prevented.

Figure 4:
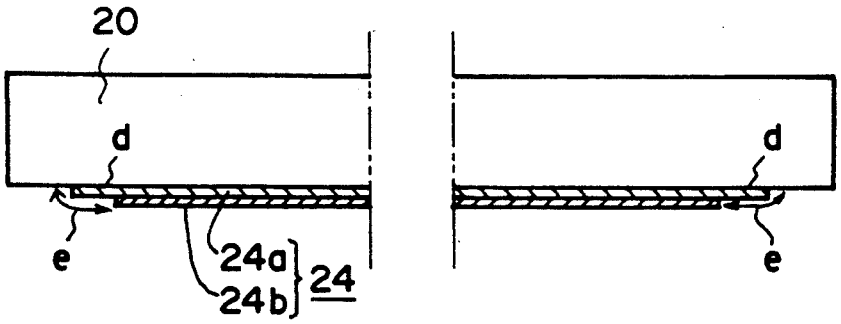
FIG. 4 is a sectional view of the heater.

FIG. 4 is a sectional view of the film 24 in the direction of the width at the position of the heater 20. The distance e between the low resistance parting layer **24*b* and the heater surface 20 is preferably not less than 2.5 and in this embodiment, it is 5 mm. Because of such a distance, leakage can be prevented between the heater 20 and the low resistance layer 24*b* of the film 24**.

Similarly, the distance e of 5 mm is provided between the low resistance parting layer **24*b* and the grounded rollers 25 and 26**, and therefore, the surface of the film is not directly grounded. This prevents the leakage of the charge applied to the transfer material P by an unshown image forming station from leaking to the ground through the transfer material P. Therefore, the possible deterioration of the image quality due to improper image transfer can be prevented in the process of transferring the toner image onto the transfer material P.

It will be understood that this embodiment is particularly effective as the heat fixing apparatus in an image forming apparatus having a distance between the transfer and fixing stations which is shorter than the maximum length of the usable recording material.

Figure 5:
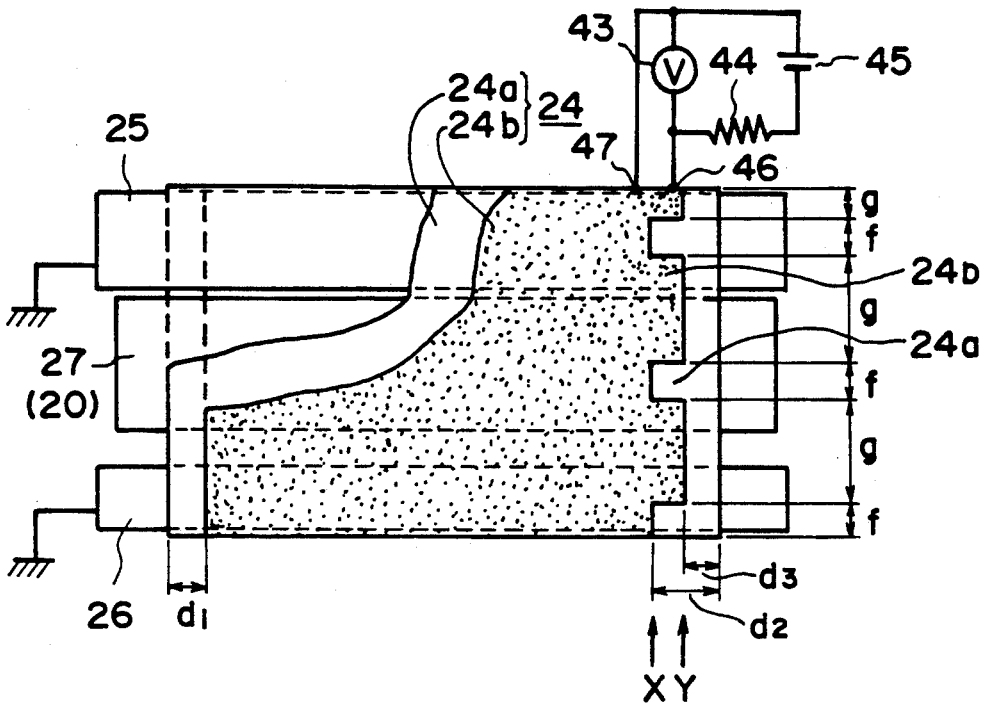
FIG. 5 is a top plan view of an apparatus according to a second embodiment of the present invention
Figure 6:
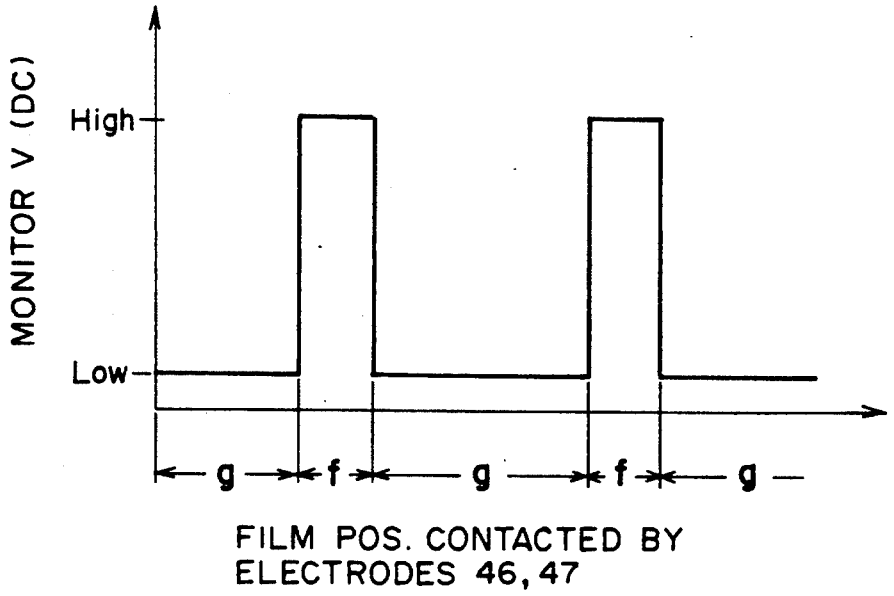
FIG. 6 shows a monitored voltage.

Referring to FIGS. 5 and 6, a second embodiment of the present invention will be described. This embodiment uses a different type of position detecting means for the endless film 24. The structure and the operation are the same as in the first embodiment. Similarly to the first embodiment, the film 24 comprises a high resistance heat resistive layer **24*a* and a low resistance parting layer 24*b*, and the low resistance layer 24*b* does not extend to the opposite end portions of the film 24 in the direction of the width thereof. Therefore, the high resistance heat resistive layer is exposed. The width of the exposed portion d1 (left at FIG. 5) is uniform in the periphery of the film 24, but the other exposed portion has periodically changing widths d2 and d3 along the periphery of the film 24**.

Two electrodes 46 and 47 are contacted to the film 24 with a predetermined space therebetween in the portion between a distance X and a distance Y from an end of the film, in the neighborhood of which the width of the exposed high resistance resistive layer **24*a* alternately changes (d2 and d3). Between the electrode 46 and 47, a constant voltage is applied from a DC source 45 through a reference resistor 44. A voltage drop between the electrode 46 and 47 is monitored by the voltage meter 43**.

When the film 24 is rotated, the alternating change of the exposed portion adjacent the end results in the periodical contacts of the electrodes 46 and 47 to the low resistance parting layer **24*b* and the high resistance parting layer 24*a***.

When the film rotates at a proper peripheral speed with the proper position in the direction perpendicular to the transfer material movement direction (the direction of the width of the film), both of the electrode 46 and 47 are in sliding contact with the film 24 in the range of the high resistance layer **24*a* exposed portion, and therefore, the voltage V monitored by the voltage meter 43** periodically and regularly changes.

However, if the film 24 does not rotate due to slippage between the film 24 and the rollers 25 and 26, for example, with the result of irregular change of the peripheral speed, the period of the monitored voltage change becomes irregular or disturbed.

In addition, if the film 24 shifts laterally toward left or right along the length of the roller 25 or 26 or the heater 20, one or both of the electrodes 46 and 47 continue to contact to the surface of the low resistance parting layer **24*b* or the surface of the high resistance heat resistive layer 24*a***, and therefore, the monitored voltage V perodically fluctuates during the intervals f and g.

Thus, by checking periodic changes of the voltage V from the voltage meter 43, any stoppage, improper rotation or the lateral shift of the film can be detected.

Similarly to the first embodiment, the leakage between the low resistance parting layer **24*b* of the film 24 and the heater 20 or the roller 25 or 26** can be prevented.

Figure 7:
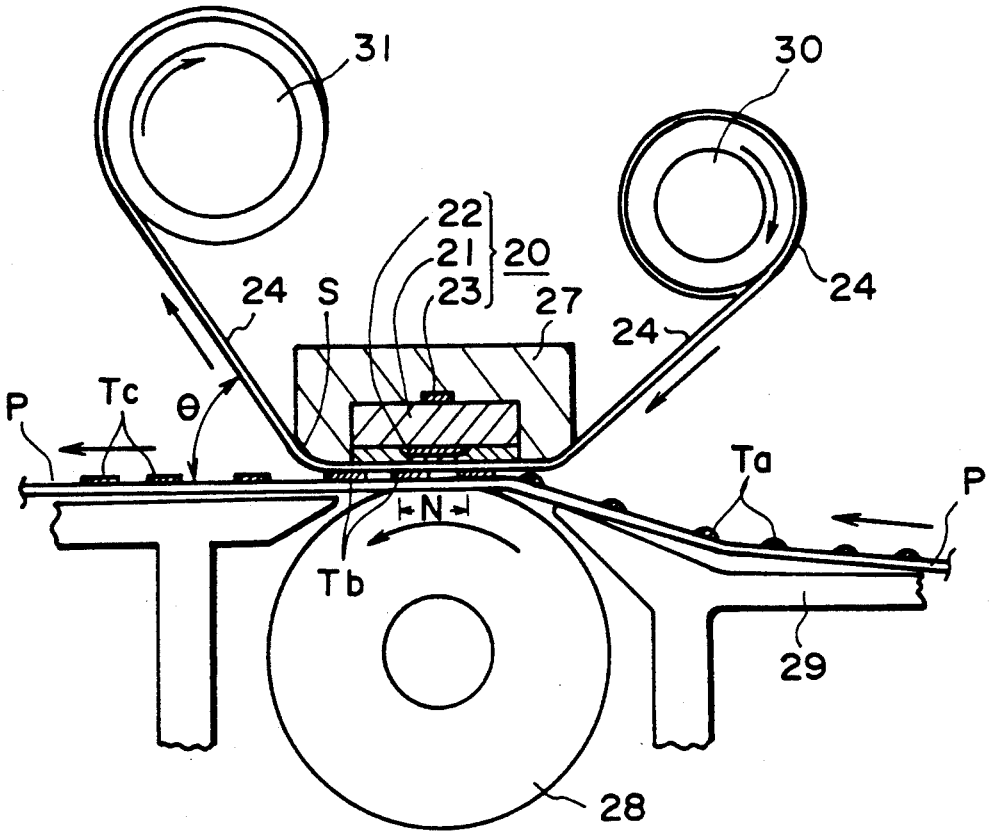
FIG. 7 is a sectional view of an apparatus according to a third embodiment of the present invention.
Figure 8:
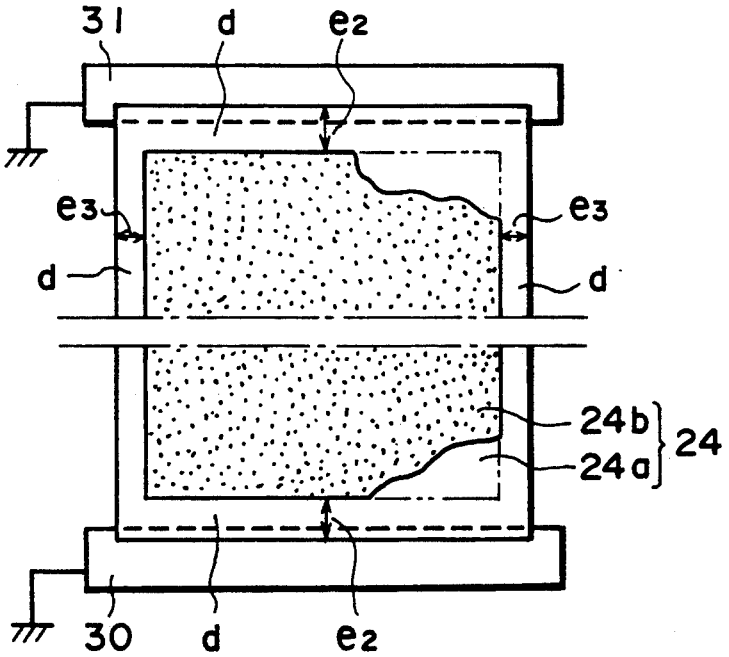
FIG. 8 is a developed top plan view of a non-endless belt used in the apparatus.

Referring to FIGS. 7 and 8, a third embodiment will be described. The fixing film 24 is not limited to an endless belt, but may be in the form of a sheet. In FIG. 7, a non-endless film 24 is rolled on a supply shaft 30, and is taken out to be wrapped on a take-up shaft 31 through the nip between the heater 20 and the pressing roller 28. Thus, the film is fed from the supply shaft 30 to the take-up shaft 31 at the speed which is equal to the speed of the transfer material P.

FIG. 8 is a developed top plan view of the non-endless film 24, wherein the film is mounted on the supply shaft 30 and the take-up shaft 31. The non-endless film 24 also comprises a high resistance heat resistive layer **24*a* and a low resistance parting layer 24*b*. At the four edge portions of the film, the low resistance parting layer is not provided, but the heat resistive layer 24*a*** having a high resistance is exposed (d).

Similarly to the first embodiment, the distance, along the surface, from the shaft 30 or 31 (e2) is preferably not less than 2.5 mm, and the exposed width of the high resistance layer in the direction of the film width (e3) is preferably not less than 2.5 mm. In this embodiment, the distance e2 is 10 mm, and the distance e3 is 5 mm. By increasing the distance e2, the direct grounding of the film surface low resistance layer 24*b* can be avoided. The electric charge on the backside of the transfer material P is prevented from leaking to the ground, the electric charge having been applied to the backside of the transfer material in the transfer station in an image forming means (not shown). Therefore, good transferred images can be provided. By increasing the distance e3, leakage between the low resistance parting layer 24*b* and the heat generating member 20 can be prevented.

As described in the foregoing, according to the present invention, the high resistance layer is provided at a side contactable to the heater, and the low resistance layer is provided at a side contactable to the recording material, in the heat resistive film, and the area of the high resistance layer is larger than the low resistance layer, so that high resistance layer exposed portions are provided at the end portions of the film. By doing so, the direct contact between the low resistance layer and the member such as heater directly contacted or disposed close to the film, can be avoided. Thus, the electrostatic offset or the improper image transfer or the like due to the short-circuit of the low resistance layer, can be avoided.

While the invention has been described with reference to the structures disclosed herein, it is not confined to the details set forth and this application is intended to cover such modifications or changes as may come within the purposes of the improvements or the scope of the following claims.

What is claimed:

1. A heating apparatus, comprising:

a heater generating heat upon electric power supply thereto;

a film, wherein an image on a recording material is heated by heat from said heater through said film;

wherein said film comprises a high electrical resistance layer at a side remote from the recording material and a low electrical resistance layer at a side remote from said heater; and wherein an area of said high resistance layer is larger than an area of said low resistance layer.

2. An apparatus according to claim 1, wherein said film is contactable to said heater and to the recording material.

3. An apparatus according to claim 1, wherein a volume resistivity of said low resistance layer is not more than $10^{11}$ ohm.cm.

4. An apparatus according to claim 1, wherein said low resistance layer is of fluorine resin containing low resistance material

5. An apparatus according to claim 4, wherein the volume resistivity of said low resistance layer is not more than $10^{10}$ ohm.cm.

6. An apparatus according to claim 1, wherein said low resistance layer is provided except for at least one lateral side of said film.

7. An apparatus according to claim 6, wherein said film is in the form of an endless belt.

8. An apparatus according to claim 1, wherein said low resistance layer has a width larger than a maximum width of usable recording materials.

9. An apparatus according to claim 1, wherein said low resistance layer is electrically grounded.

10. An apparatus according to claim 1, wherein a volume resistivity of said high resistance layer is not less than $10^{12}$ ohm.cm.

11. An apparatus according to claim 1, wherein said high resistance layer is of polyimide.

12. An apparatus according to claim 1, wherein said apparatus heat-fixes an image on the recording material.

* * * * *

UNITED STATES PATENT AND TRADEMARK OFFICE

CERTIFICATE OF CORRECTION

PATENT NO. : 5,157,446

DATED : October 20, 1992

INVENTOR(S) : Kensaku Kusaka

It is certified that error appears in the above-identified patent and that said Letters Patent is hereby corrected as shown below:

COLUMN 1

Line 43, "give" should read --gives--.
Line 52, "or" should read --with or--.
Line 53, "with" should be deleted.

COLUMN 2

Line 58, "image, not" should read --image forming means, not--.
Line 59, "forming means" should be deleted.

COLUMN 3

Line 23, "center," should read --center--.
Line 48, "solenoid" should read --solenoid,--.

COLUMN 4

Line 8, "time sheet" should read --time the sheet--.
Line 19, "is" should read --are--.
Line 55, "silicone," should read --silicone--.
Line 59, "coating)" should read --(coating)--.

COLUMN 5

Line 15, "is" (first occurrence) should be deleted.

UNITED STATES PATENT AND TRADEMARK OFFICE

CERTIFICATE OF CORRECTION

PATENT NO. : 5,157,446

DATED : October 20, 1992

INVENTOR(S) : Kensaku Kusaka

It is certified that error appears in the above-identified patent and that said Letters Patent is hereby corrected as shown below:

COLUMN 6

Line 10, "electrode 46" should read --electrodes 46--.
Line 13, "electrode 46" should read --electrodes 46--.
Line 23, "electrode 46" should read --electrodes 46--.

Signed and Sealed this

Seventh Day of December, 1993

*Attest:*

*Attesting Officer*

Bruce Lehman

BRUCE LEHMAN

*Commissioner of Patents and Trademarks*